US005622390A

United States Patent [19]

Jenkins

[11] Patent Number: 5,622,390

[45] Date of Patent: Apr. 22, 1997

[54] TWO WAY SELF MAILER FROM ONE PLY OF PAPER

[75] Inventor: Richard A. Jenkins, Lindenhurst, Ill.

[73] Assignee: Moore Business Forms, Inc., Grand Island, N.Y.

[21] Appl. No.: 533,993

[22] Filed: Sep. 27, 1995

[51] Int. Cl.[6] ..... B42D 15/00

[52] U.S. Cl. ..... 283/116; 229/300; 462/6

[58] Field of Search ..... 283/56, 116, 117; 462/6, 900, 64; 229/300, 301, 307, 313, 92, 92.1, 92.8

[56] References Cited

U.S. PATENT DOCUMENTS

| | | |
|---|---|---|
| 1,091,172 | 3/1914 | Thayer . |
| 2,317,335 | 4/1943 | Whitman . |
| 2,402,821 | 6/1946 | Kosteling . |
| 3,946,938 | 3/1976 | Kranz . |
| 4,706,878 | 11/1987 | Lubotta et al. . |
| 4,754,915 | 7/1988 | Steidinger . |
| 4,951,864 | 8/1990 | Dicker . |
| 5,263,637 | 11/1993 | Simson . |
| 5,288,014 | 2/1994 | Meyers et al. . |
| 5,290,225 | 3/1994 | Younger . |
| 5,314,110 | 5/1994 | Lombardo . |
| 5,346,123 | 9/1994 | Lombardo . |
| 5,370,304 | 12/1994 | Sauerwine et al. . |
| 5,375,764 | 12/1994 | Sauerwine . |
| 5,376,048 | 12/1994 | Whiteside ..... 283/116 X |
| 5,421,620 | 6/1995 | Sauerwine ..... 283/116 |

*Primary Examiner*—Willmon Fridie, Jr.
*Attorney, Agent, or Firm*—Nixon & Vanderhye P.C.

[57] ABSTRACT

A mailer type business form and intermediate are constructed from a single sheet of paper to include a reply envelope. The sheet is devoid of cut outs or windows, yet may be simplex printed with the reply and outgoing addresses formed on the same face of the intermediate and having the same orientation. The mailer is easily opened by removing tear strips along the edges, a data panel is detached from a reply envelope flap, and a ply containing the outgoing address detached from the reply envelope so that no computer printing or postal service bar code pertaining to the outgoing address is visible on the reply envelope, including the closing flap portion of the reply envelope.

20 Claims, 4 Drawing Sheets

FIG. 3
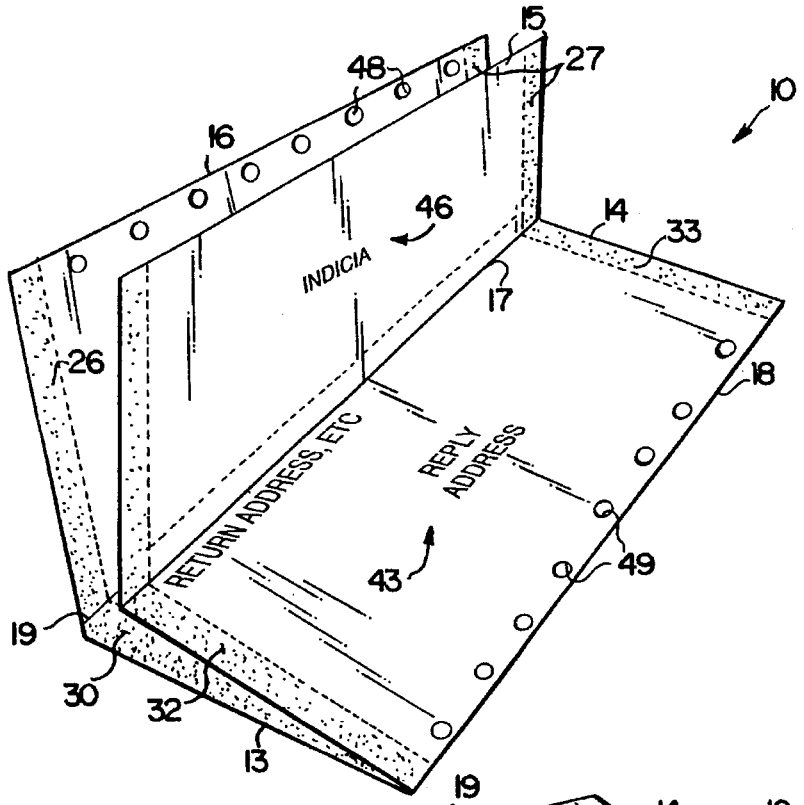
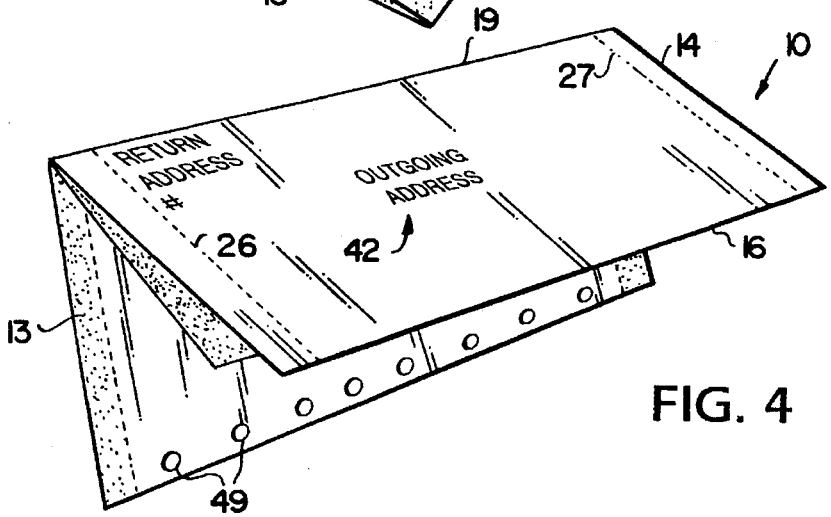
FIG. 4
FIG. 5
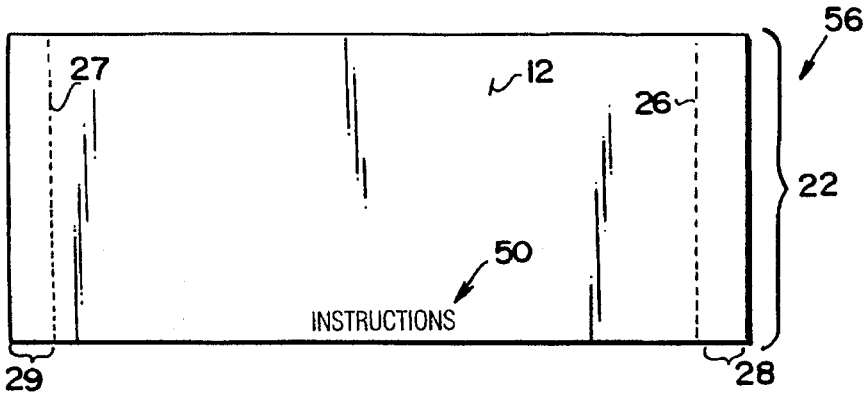

TWO WAY SELF MAILER FROM ONE PLY OF PAPER

BACKGROUND AND SUMMARY OF THE INVENTION

In the construction of intermediates for mailer type business forms, and the mailers themselves, where it is desirable to provide reply envelopes, several features are desirable. First of all it is desirable to ensure that no part of the reply envelope (including the flap for sealing the reply envelope) has any computer printing or USPS bar code pertinent to the outgoing envelope which is visible on the reply envelope since that may undesirably impact upon the deliverability of the outgoing envelope. Also it is desirable to be able to simplex print the outgoing and reply addresses (as well as other indicia, such as the customer account number in the return address portion of the reply envelope) and in such a way that all of the indicia have the same orientation. This provides for maximum ease of construction and utility of the intermediates and mailers. Also it is desirable that the intermediate is formed by—and the mailer is constructed from—a single sheet of paper, such as a legal size sheet (although other size sheets may also be provided as long as the final mailer and reply envelope have an appropriate size for USPS regulations).

According to one aspect of the present invention an intermediate for a mailer type business form is provided comprising the following components: A sheet of paper having first and second opposite parallel longitudinal edges; first and second opposite end edges; a first face adapted to provide the majority of the interior of a mailer when constructed from the sheet; and a second face adapted to provide the exterior of the mailer when constructed. First, second and third fold lines formed in the sheet perpendicular to the longitudinal edges, and dividing the sheet into, in sequence, first, second, third and fourth panels, the first panel being defined by the first end edge and the first fold line, and the fourth panel by the second end edge and the third fold line. First and second longitudinal lines of weakness formed in the sheet parallel to and adjacent, but spaced from, the longitudinal edges to define first and second tear strips. First and second adhesive patterns disposed on the tear strips to hold the sheet into a mailer when folded about the fold line. Third adhesive patterns disposed on the first face of at least one of the second and third panels for joining the second and third panels together adjacent the first and second longitudinal lines of weakness and adjacent the second fold line for forming a reply envelope when the sheet is folded about the fold lines. A first transverse line of weakness formed in the first panel parallel to and adjacent, but spaced from, the first fold line to define a reply envelope flap. And, a fourth adhesive pattern formed on the first face of the reply envelope flap.

Preferably the intermediate is substantially continuous, being devoid of cut outs or windows. Also the reply address indicia when imaged on the intermediate second panel second face has an upright, readable orientation when the first end edge is at the top of the intermediate. The outgoing address indicia, when variably imaged on the fourth panel second face, has this same orientation. Also the outgoing addressee's account number, and like indicia, may be imaged at the "return address" portion of the second panel second face (forming the outside of the reply envelope).

Typically the second and third fold lines are lines of weakness. Also the fold lines are positioned so that the first panel has a length that is a distance X less than the lengths of the second through fourth panels, and a fifth readily releasable adhesive pattern is preferably disposed on the first face of the fourth panel adjacent the second end edge, and not extending substantially more than the distance X from the second end edge.

According to another aspect of the present invention an intermediate for a mailer type business form is provided comprising the following components: A sheet of paper having first and second opposite parallel longitudinal edges; first and second opposite end edges; a first face adapted to provide the majority of the interior of a mailer when constructed from the sheet; and a second face adapted to provide the exterior of the mailer when constructed. First, second and third fold lines formed in the sheet perpendicular to the longitudinal edges, and dividing the sheet into, in sequence, first, second, third and fourth panels, the first panel being defined by said first end edge and the first fold line, and the fourth panel by the second end edge and the third fold line. First and second longitudinal lines of weakness formed in the sheet parallel to and adjacent, but spaced from, the longitudinal edges to define first and second tear strips. First and second adhesive patterns disposed on the tear strips to hold the sheet into a mailer when folded about the fold lines. Third adhesive patterns disposed on the first face of at least one of the second and third panels for joining the second and third panels together adjacent the first and second longitudinal lines of weakness and adjacent the second fold line for forming a reply envelope when the sheet is folded about the second fold line. Reply address indicia imaged on the second face of the second panel, the indicia upright when the first end edge is at the top of the intermediate. And, outgoing address indicia imaged on the second face of the fourth panel, the outgoing address indicia being upright and readable when the first end edge is at the top of the intermediate.

The details of the intermediate according to this aspect of the invention are preferably as described above with respect to the first aspect of the invention.

The invention also comprises a mailer type business form. The mailer type form comprises the following components: First, second, third and fourth plies each having first and second faces, longitudinal edges, and end edges. The first ply having outgoing address indicia imaged on the first face thereof, the first face being an exterior face of the mailer, and the outgoing address being readable when the first end edge thereof is at the top of the mailer. Aligned first and second longitudinal lines of weakness formed in each of the plies adjacent but spaced from the longitudinal edges thereof to define tear-off strips. First and second adhesive patterns provided in the tear-off strips connecting the second face of the first ply in face-to-face engagement with the first face of the second ply, and the second face of the second ply in face-to-face engagement with the first face of the third ply, and the second face of the third ply in face-to-face engagement with the first face of the fourth ply. Third adhesive patterns disposed adjacent the first and second longitudinal lines of weakness on the opposite sides thereof from the first and second longitudinal edges, and adjacent the second end edges of the third and fourth plies for holding the second face of the third ply in face-to-face engagement with the first face of the fourth ply even when the tear-off strips have been removed, defining a reply envelope. And, reply address indicia formed on the first face of the third ply and being upright and readable when the first end edge of the first ply is at the top.

In the mailer according to the present invention the construction is preferably such so that the second ply has a longitudinal dimension that is shorter by the distance X from the first and third plies so that the second end edge of the second ply is spaced from the second end edges of the first and third plies; and the mailer further comprises a fourth adhesive pattern formed adjacent the second end edges of the first ply second face or the third ply first face for holding the second face of the first ply adjacent the second end edge thereof to the first face of the third ply adjacent the second end edge thereof in a readily releasable manner. The readily releasable adhesive pattern preferably comprises spaced adhesive spots. The mailer also preferably comprises a line of weakness formed in the second ply adjacent the first end edge thereof to define a reply envelope flap; and further comprises a user activated adhesive pattern formed on the first face of said second ply at the reply envelope flap; an account number imaged on the first face of the third ply adjacent the first longitudinal line of weakness and adjacent the first end edge thereof; and, indicia imaged on the second face of the second ply.

It is the primary object of the present invention to provide a simple, versatile, and effective intermediate for a mailer type business form, and mailer type business form, that can be easily simplex printed and will not have any adverse extraneous indicia (such as USPS bar code) on the reply enveloped, including the sealing flap thereof. This and other objects of the invention will become clear from an inspection of the detailed description of the invention and from the appended claims.

BRIEF DESCRIPTION OF THE DRAWINGS

FIG. 3 is a first perspective view showing the interior of the intermediate of FIGS. 1 and 2 as it is being folded into a mailer according to the present invention;

FIG. 4 is another perspective view of the intermediate of FIGS. 1 and 2 as it is being folded into an exemplary mailer according to the present invention;

FIG. 5 is a rear view of the mailer according to the present invention formed by folding the intermediate of FIGS. 1 and 2 as illustrated in FIGS. 3 and 4;

DETAILED DESCRIPTION OF THE DRAWINGS

Figure 1:
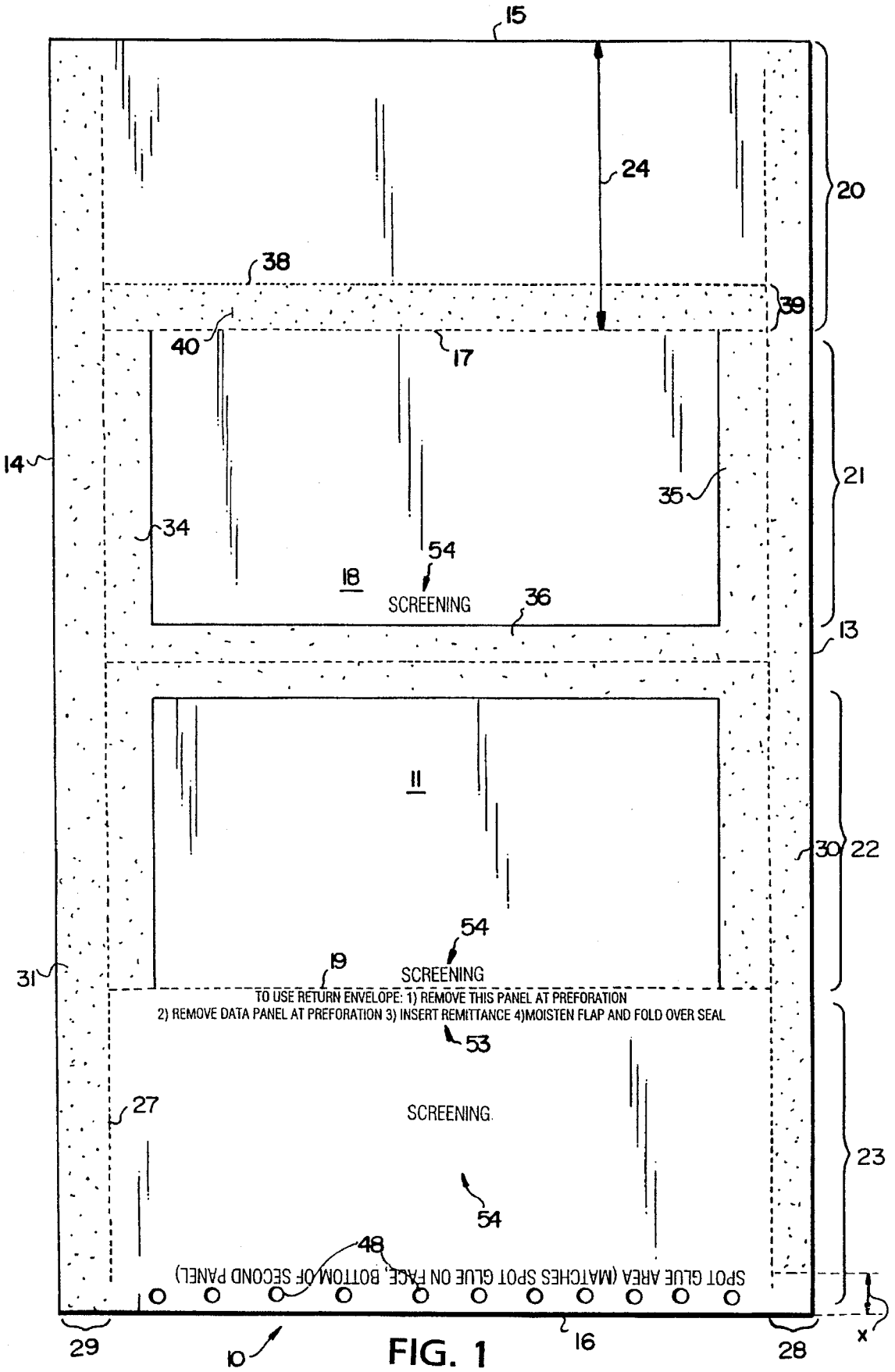
FIG. 1 is a top plan view of a first face of an exemplary intermediate according to the present invention.
Figure 2:
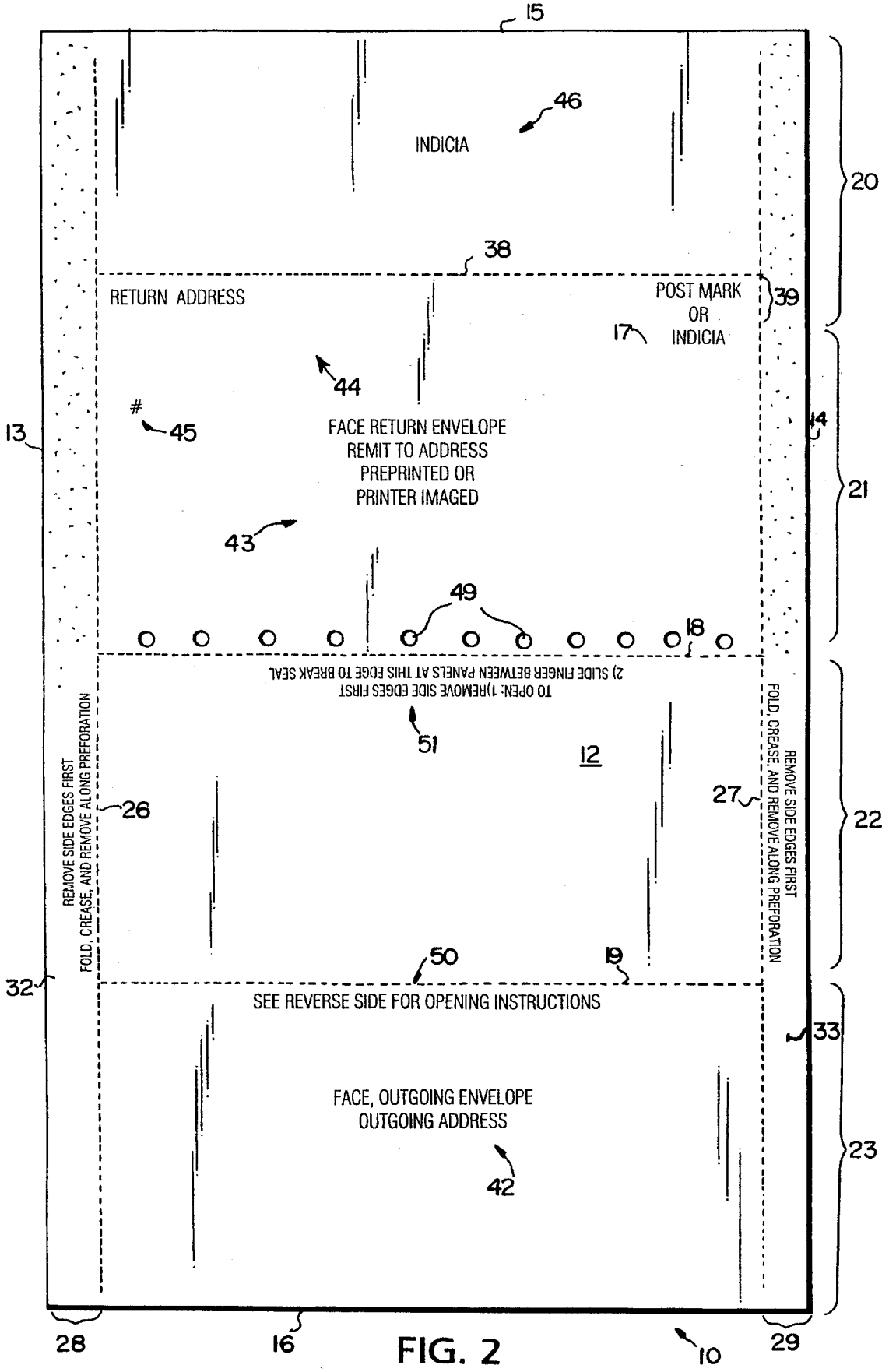
FIG. 2 is a top plan view of a second face of the intermediate of FIG. 1.

An exemplary intermediate according to the present invention is shown generally by reference numeral 10 in FIGS. 1 and 2, the intermediate being formed from a sheet of paper (such as an 8½×14 inch sheet, or other appropriately sized sheet that can form mailers having a suitable size according to USPS regulations) having a first face 11 thereof (FIG. 1) and a second face 12 (FIG. 2). The sheet of paper forming the intermediate 10 has first and second opposite parallel longitudinal edges 13, 14, and first and second opposite end edges 15, 16, the edges 15, 16 being substantially perpendicular to the edges 13, 14. The first face 11 provides the majority of the interior of the mailer constructed from the sheet 10, while the second face 12 provides the exterior of the mailer.

The intermediate 10 further comprises first, second, and third fold lines 17, 18, 19, respectively. The fold lines 17 through 19 are perpendicular to the longitudinal edges 13, 14 and divide the sheet 10 into, in sequence, first, second, third, and fourth panels. The first panel is shown by reference numeral 20 in FIGS. 1 through 4, and the second panel by reference numeral 21, the third panel by reference numeral 22, and the fourth panel by reference numeral 23. The fold lines 17 through 19 may be any suitable type of fold lines such as score lines, creases, or lines of weakness, and preferably at least the lines 18, 19 are lines of weakness (such as perforations). The panels 21 through 23 are of substantially the same size while the panel 20 has a length 24 which is less than the length of the panels 21 through 23 by a distance X, which distance X is shown measured on the fourth panel 23 from the second end edge 16 thereof.

The intermediate 10 also comprises first and second longitudinal lines of weakness 26, 27, respectively, such as perforation lines, or other conventional lines of weakness, which are substantially parallel to but spaced from the first and second longitudinal edges 13, 14, respectively, to define tear-off strips 28, 29, respectively. First and second adhesive patterns, shown schematically by reference numerals 30, 31, 32, and 33, are provided in the tear-off strips 28, 29. These adhesive patterns may be strips of adhesive, or spaced adhesive elements such as rectangles, blocks, triangles, spots, or the like, and they may be provided throughout the length of the tear strips 28, 29 as schematically illustrated in FIGS. 1 and 2, or may only be provided at portions thereof sufficient to hold the mailer to be formed together when the intermediate 10 is folded about the fold lines 17 through 19. The adhesive patterns 30–33 may comprise any suitable machine activated adhesive, such as pressure cohesive (such as available from Moore Business Forms, Inc. of Lake Forest, Ill.), heat seal adhesive, machine activated rewettable adhesive, or any other suitable conventional adhesive type.

The intermediate 10 also comprises a third adhesive pattern which is illustrated in FIG. 1 and is applied on the first face 11 in the second and third panels (or one of the second and third panels) 21, 22 thereof. The third adhesive pattern in the embodiment actually illustrated in FIG. 1 is shown having the adhesive strips 34, 35, 36 which again may be continuous strips of adhesive, spaced blocks, spots, or the like, and may be provided on the face 11 of both of the panels 21, 22 adjacent the lines of weakness 26, 27 and the fold line 18, thereof, or on only one of the panels 21, 22 depending upon the type of adhesive forming the patterns 34–36. The adhesive of the patterns 34–36 is selected from the same types of adhesive as described above with respect to the adhesive patterns 30–33 and is preferably of the same type as the adhesive 30–33 although under some circumstances may be a different type. The adhesive patterns 34–36 holds the panels 21, 22 into a reply envelope even after detachment of the tear strips 28, 29 along the lines of weakness 26, 27.

The intermediate 10 further comprises a first transverse line of weakness 38 formed in the first panel 20 and adjacent but spaced from the first fold line 17 to define a reply envelope sealing flap 39. User activated adhesive, as illustrated by the pattern of adhesive 40 in FIG. 1, is preferably provided on the face 11 of the flap 39. By providing this particular construction, the flap 39 is in the interior of the mailer constructed from the intermediate 10 and therefore does not have any USPS bar code, cancellation indicia, or other extraneous indicia thereon which might adversely affect the deliverability of the reply envelope formed from the intermediate 10. The user activated adhesive 40 may be rewettable adhesive, or pressure sensitive adhesive covered by a release sheet, or any other suitable conventional user activated adhesive.

In the use of the intermediate 10 to construct a mailer, the intermediate 10 is simplex printed with variable indicia, including outgoing address indicia 42, optionally reply address indicia 43, and return address indicia 44 which may include the outgoing addressee's account number as illustrated schematically at 45 (all seen in FIG. 2). The indicia 42 through 45 are simplex printed on the second face 12, and the indicia 42 and 43, and typically all the indicia 42 through 45, have the same orientation. That is the indicia 42 through 45 are all upright and readily readable when the first end edge 15 is at the top of the intermediate 10. The indicia 42 and 45 will typically always be variable printed and the indicia 43 and 44 are desirably variably printed although they may be pre-printed before the intermediate 10 is simplex printed. Also indicia 46, which may comprise important data, may either be pre-printed or variably printed on the second face 12 of the first panel 20, a data panel provided when there is detachment of the indicia 46 containing portion at the perforation lines 26, 27 and 38 [the data panel being savable by the recipient, or returned in the reply envelope].

The intermediate 10 further may optionally comprise another readily, releasable, adhesive pattern such as shown at 48 and 49 in FIGS. 1 and 2, respectively, for helping to seal the mailer form constructed from the intermediate 10. The adhesive patterns 48, 49, in order to be readily releasable, may, for example, comprise a plurality of spaced adhesive spots as illustrated in FIGS. 1 and 2. While the spots hold quite securely when pressed into engagement with each other (the spots 48, 49 being aligned), since they only hold along a relatively small portion of the width of the panels 23, 21, they may be readily separated by the outgoing addressee without tearing the panels 21, 23.

The intermediate 10 may also comprise a variety of different instruction indicia such as illustrated schematically at 50 and 51 in FIG. 2 and 53 in FIG. 1, and there may be screening of various first faces of the panels as illustrated schematically at 54 in FIG. 1. The screening provides privacy of the mailer and reply envelope, making it difficult to read indicia therein.

Figure 6:
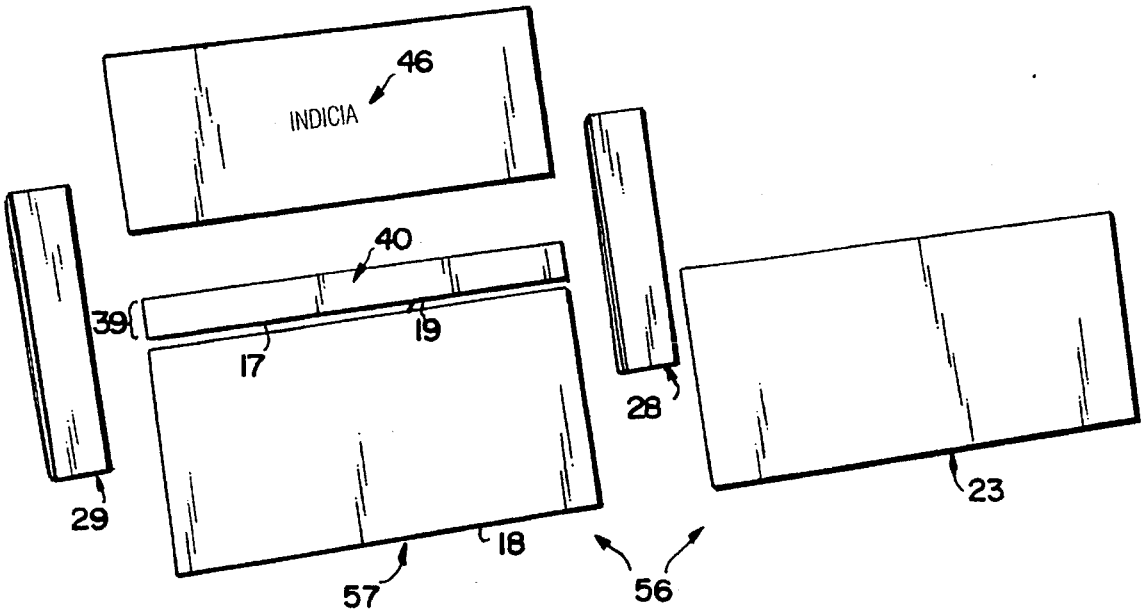
FIG. 6 is a perspective exploded view of the mailer of FIG. 5 after removal of the tear strip and separation of the data panel and outgoing address ply.
Figure 7:
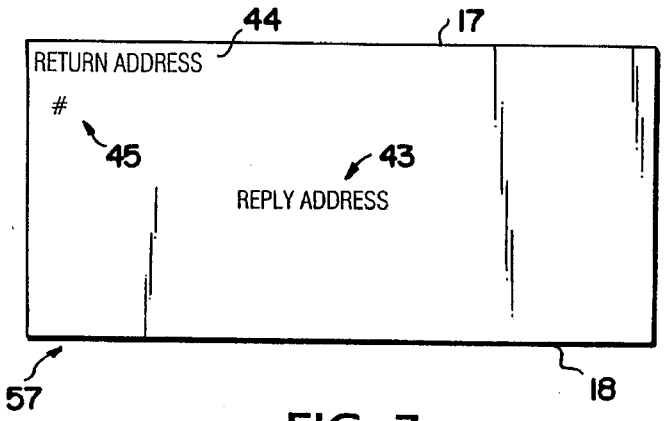
FIG. 7 is a front view of the reply envelope from the opened mailer of FIG. 6 after the reply mailer flap has been folded and sealed.

FIGS. 3 and 4 illustrate the folding of the intermediate 10 about the fold lines 17 through 19 to form a mailer type business form, shown schematically at 56 in FIG. 5. FIG. 6 illustrates the mailer 56 after it has been opened by removing the tear strips 28, 29. FIG. 7 shows the reply envelope 57 after the flap 39 thereof has been sealed.

In the mailer 56, the panels 20 through 23 form various plies of the mailer. The first ply is formed by the panel 23 and has a first exterior face which is the face 12 of the panel 23 having the outgoing address indicia 42 thereon, while the second face of the panel 23 (first ply) is the interior face 11. The interior face 11 is in face-to-face engagement with the first face 11 of the second ply which is formed from the first panel 20 while the second face 12 of the second ply (formed from panel 20) is in face-to-face engagement with the first face 12 of the third ply (which is formed from the second panel 21), having the reply address indicia 43 thereon. The second face 11 of the third ply (second panel 21) is in face-to-face engagement with the first face 11 of the fourth ply (third panel 22) while the second face 12 of the fourth ply (third panel 22) forms the back exterior of the mailer 56 as illustrated in FIG. 5. The adhesive patterns 30 through 33 and 48, 49 hold the mailer 56 in its outgoing configuration, while the adhesive patterns 34 through 36 hold the reply envelope 57 together.

After the tear strips 28, 29 are removed along the lines of weakness 26, 27 the rest of the mailer 56 may be detached as illustrated in FIG. 6. After a suitable insert (such as a check) has been inserted into the open top of the reply envelope 57 (adjacent the edge 19, fonned by the fold line 19) the adhesive 40 is activated by the user (such as licking it or removing a release strip) and then the sealing flap 39 is folded about the fold line 17, to seal the reply envelope 57 as illustrated in FIG. 7.

It will thus be seen that according to the present invention a readily simplex printed mailer type business form intermediate, and mailer produced therefrom, which has no extraneous indicia on the reply envelope exterior (including the sealing flap thereof) has been provided, the mailer constructed from a single sheet of paper typically devoid of windows or cut outs. While the invention has been herein shown and described in what is presently conceived to be the most practical and preferred embodiments thereof it will be apparent to those of ordinary skill in the art that many modifications may be made thereof within the scope of the invention of the invention, which scope is to be accorded the broadest interpretation of the appended claims so as to encompass all equivalent structures and constructions.

What is claimed is:

1. A mailer type business form intermediate comprising:

a sheet of paper having first and second opposite parallel longitudinal edges; first and second opposite end edges; a first face adapted to provide the majority of the interior of a mailer when constructed from the sheet; and a second face adapted to provide the exterior of the mailer when constructed;

first, second and third fold lines formed in said sheet perpendicular to said longitudinal edges, and dividing said sheet into, in sequence, first, second, third and fourth panels, said first panel being defined by said first end edge and said first fold line, and said fourth panel by said second end edge and said third fold line;

first and second longitudinal lines of weakness formed in said sheet parallel to and adjacent, but spaced from, said longitudinal edges to define first and second tear strips;

first and second adhesive patterns disposed on said tear strips to hold said sheet into a mailer when folded about said fold line;

third adhesive patterns disposed on said first face of at least one of said second and third panels for joining said second and third panels together adjacent said first and second longitudinal lines of weakness and adjacent said second fold line for forming a reply envelope when said sheet is folded about said fold lines;

a first transverse line of weakness formed in said first panel parallel to and adjacent, but spaced from, said first fold line to define a reply envelope flap; and a fourth adhesive pattern formed on said first face of said reply envelope flap.

2. An intermediate as recited in claim 1 wherein said sheet is continuous, being devoid of cut-outs or windows.

3. An intermediate as recited in claim 1 further comprising reply address indicia imaged on said second face of said second panel, said indicia upright when said first end edge is at the top of said intermediate.

4. An intermediate as recited in claim 3 further comprising outgoing address indicia imaged on said second face of said fourth panel, said outgoing address indicia being upright and readable when said first end edge is at the top of said intermediate.

5. An intermediate as recited in claim 1 wherein said second and third fold lines are lines of weakness.

6. An intermediate as recited in claim 1 further comprising outgoing address indicia imaged on said second face of said fourth panel, said outgoing address indicia being upright and readable when said first end edge is at the top of said intermediate.

7. An intermediate as recited in claim 4 wherein said sheet is continuous, being devoid of cut-outs or windows.

8. A mailer as recited in claim 1 wherein said fold lines are positioned so that said first panel has a length that is a distance X less than the lengths of said second through fourth panels; and further comprising a fifth readily releasable adhesive pattern disposed on said first face of said fourth panel adjacent said second end edge, and not extending substantially more than said distance X from said second end edge.

9. An intermediate as recited in claim 3 further comprising account number indicia provided on said second face of said second panel in the upper left corner thereof adjacent said first longitudinal line of weakness when said first end edge is at the top of said intermediate.

10. A mailer type business form intermediate comprising:

a sheet of paper having first and second opposite parallel longitudinal edges; first and second opposite end edges; a first face adapted to provide the majority of the interior of a mailer when constructed from the sheet; and a second face adapted to provide the exterior of the mailer when constructed;

first, second and third fold lines formed in said sheet perpendicular to said longitudinal edges, and dividing said sheet into, in sequence, first, second, third and fourth panels, said first panel being defined by said first end edge and said first fold line, and said fourth panel by said second end edge and said third fold line;

first and second longitudinal lines of weakness formed in said sheet parallel to and adjacent, but spaced from, said longitudinal edges to define first and second tear strips;

first and second adhesive patterns disposed on said tear strips to hold said sheet into a mailer when folded about said fold line;

third adhesive patterns disposed on said first face of at least one of said second and third panels for joining said second and third panels together adjacent said first and second longitudinal lines of weakness and adjacent said second fold line for forming a reply envelope when said sheet is folded about said fold lines;

reply address indicia imaged on said second face of said second panel, said indicia upright when said first end edge is at the top of said intermediate; and outgoing address indicia imaged on said second face of said fourth panel, said outgoing address indicia being upright and readable when said first end edge is at the top of said intermediate.

11. An intermediate as recited in claim 10 wherein said sheet is continuous, being devoid of cut-outs or windows.

12. An intermediate as recited in claim 11 wherein said second and third fold lines are lines of weakness.

13. An intermediate as recited in claim 10 further comprising account number indicia provided on said second face of said second panel in the upper left corner thereof adjacent said first longitudinal line of weakness when said first end edge is at the top of said intermediate.

14. An intermediate as recited in claim 10 wherein said fold lines are positioned so that said first panel has a length that is a distance X less than the lengths of said second through fourth panels; and further comprising a fourth readily releasable adhesive pattern disposed on said first face of said fourth panel adjacent said second end edge, and not extending substantially more than said distance X from said second end edge.

15. A multi-ply mailer with a built in reply envelope comprising:

first, second, third and fourth plies each having a first and second faces, longitudinal edges, and end edges;

said first ply having outgoing address indicia imaged on said first face thereof, said first face being an exterior face of said mailer, and said outgoing address being readable when said first end edge thereof is at the top of said mailer;

aligned first and second longitudinal lines of weakness formed in each of said plies adjacent but spaced from said longitudinal edges thereof to define tear-off strips;

first and second adhesive patterns provided in said tear-off strips connecting said second face of said first ply in face-to-face engagement with said first face of said second ply, and said second face of said second ply in face-to-face engagement with said first face of said third ply, and said second face of said third ply in face-to-face engagement with said first face of said fourth ply;

third adhesive patterns disposed adjacent said first and second longitudinal lines of weakness on the opposite sides thereof from said first and second longitudinal edges, and adjacent said second end edges of said third and fourth plies for holding said second face of said third ply in face-to-face engagement with said first face of said fourth ply even when said tear-off strips have been removed, defining a reply envelope; and reply address indicia formed on said first face of said third ply and being upright and readable when said first end edge of said first ply is at the top.

16. A mailer as recited in claim 15 wherein said second ply has a longitudinal dimension that is shorter by the distance X from said first and third plies so that said second end edge of said second ply is spaced from said second end edges of said first and third plies; and further comprising a fourth adhesive pattern formed adjacent said second end edges of said first ply second face or said third ply first face for holding said second face of said first ply adjacent said second end edge thereof to said first face of said third ply adjacent said second end edge thereof in a readily releasable manner.

17. A mailer as recited in claim 16 wherein said readily releasable fourth adhesive pattern comprises spaced glue spots.

18. A mailer as recited in claim 15 further comprising a line of weakness formed in said second ply adjacent said first end edge thereof to define a reply envelope flap; and further comprising a user activated adhesive pattern formed on said first face of said second ply at said reply envelope flap.

19. A mailer as recited in claim 15 further comprising an account number imaged on said first face of said third ply adjacent said first longitudinal line of weakness and adjacent said first end edge thereof.

20. A mailer as recited in claim 16 further comprising indicia imaged on said second face of said second ply.

* * * * *